US009759043B2

(12) United States Patent
Zhao

(10) Patent No.: US 9,759,043 B2
(45) Date of Patent: Sep. 12, 2017

(54) DOWNHOLE FLUID FLOW CONTROL SYSTEM AND METHOD HAVING AUTONOMOUS FLOW CONTROL

(71) Applicant: Floway, Inc., Plano, TX (US)

(72) Inventor: Liang Zhao, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 41 days.

(21) Appl. No.: 15/012,737

(22) Filed: Feb. 1, 2016

(65) Prior Publication Data

US 2017/0089173 A1 Mar. 30, 2017

Related U.S. Application Data

(63) Continuation of application No. PCT/US2015/053184, filed on Sep. 30, 2015.

(51) Int. Cl.
*E21B 34/08* (2006.01)
*E21B 47/06* (2012.01)

(52) U.S. Cl.
CPC ..... *E21B 34/08* (2013.01); *E21B 47/06* (2013.01)

(58) Field of Classification Search
CPC ..... E21B 34/08; E21B 43/08; E21B 47/06; E21B 43/12; G05D 7/01; G05D 7/0113; G05D 7/0146; G05D 7/0153; G05D 7/00; F16K 31/122; Y10T 137/0379; Y10T 137/2562
See application file for complete search history.

(56) References Cited

U.S. PATENT DOCUMENTS

| | | | |
|---|---|---|---|
| 6,786,285 | B2 | 9/2004 | Johnson et al. |
| 7,823,645 | B2 | 11/2010 | Henriksen et al. |
| 7,870,906 | B2 | 1/2011 | Ali |
| 8,235,128 | B2 | 8/2012 | Dykstra et al. |
| 8,584,762 | B2 | 11/2013 | Fripp et al. |
| 8,752,629 | B2 | 6/2014 | Moen |
| 8,875,797 | B2 | 11/2014 | Aakre et al. |
| 2011/0067878 | A1 | 3/2011 | Aadnoy |
| 2011/0198097 | A1 | 8/2011 | Moen |
| 2015/0040990 | A1 | 2/2015 | Mathiesen et al. |
| 2015/0060084 | A1 | 3/2015 | Moen et al. |

OTHER PUBLICATIONS

International Search Report and Written Opinion, PCT/US2015/053184, Dec. 28, 2015.

*Primary Examiner* — Wei Wang
(74) *Attorney, Agent, or Firm* — McGuireWoods

(57) ABSTRACT

A downhole fluid flow control system and method includes a fluid control module having a main fluid pathway, a valve element and a pressure sensing module. The valve element has open and closed positions relative to the main fluid pathway to allow and prevent fluid flow therethrough. The pressure sensing module includes a secondary fluid pathway in parallel with the main fluid pathway having an upstream pressure sensing location and a downstream pressure sensing location. In operation, the valve element moves between open and closed positions responsive to a pressure difference between pressure signals from the upstream and downstream pressure sensing locations. The pressure difference is dependent upon the viscosity of a fluid flowing through the secondary fluid pathway such that the viscosity is operable to control fluid flow through the main fluid pathway.

20 Claims, 6 Drawing Sheets

DOWNHOLE FLUID FLOW CONTROL SYSTEM AND METHOD HAVING AUTONOMOUS FLOW CONTROL

CROSS-REFERENCE TO RELATED APPLICATIONS

The present application is a continuation of co-pending application number PCT/US2015/053184, filed Sep. 30, 2015.

TECHNICAL FIELD

This disclosure relates, in general, to equipment utilized in conjunction with operations performed in subterranean production and injection wells and, in particular, to a downhole fluid flow control system and method having fluid property dependent autonomous flow control.

BACKGROUND

Without limiting the scope of the present disclosure, its background will be described with reference to producing fluid from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to control the flowrate of production fluids into the production tubing, it is common practice to install a fluid flow control system within the tubing string including one or more inflow control devices such as flow tubes, nozzles, labyrinths or other tortuous path devices. Typically, the production flowrate through these inflow control devices is fixed prior to installation based upon the design thereof.

It has been found, however, that due to changes in formation pressure and changes in formation fluid composition over the life of the well, it may be desirable to adjust the flow control characteristics of the inflow control devices and, in particular, it may be desirable to adjust the flow control characteristics without the requirement for well intervention. In addition, for certain completions, such as long horizontal completions having numerous production intervals, it may be desirable to independently control the inflow of production fluids into each of the production intervals.

Attempts have been made to achieve these result through the use of autonomous inflow control devices. For example, certain autonomous inflow control devices include one or more valve elements that are fully open responsive to the flow of a desired fluid, such as oil, but restrict production responsive to the flow of an undesired fluid, such as water or gas. It has been found, however, that systems incorporating current autonomous inflow control devices suffer from one or more of the following limitations: fatigue failure of biasing devices; failure of intricate components or complex structures; lack of sensitivity to minor fluid property differences, such as light oil viscosity versus water viscosity; and/or the inability to highly restrict or shut off unwanted fluid flow due to requiring substantial flow or requiring flow through a main flow path in order to operate.

Accordingly, a need has arisen for a downhole fluid flow control system that is operable to independently control the inflow of production fluids from multiple production intervals without the requirement for well intervention as the composition of the fluids produced into specific intervals changes over time. A need has also arisen for such a downhole fluid flow control system that does not require the use of biasing devices, intricate components or complex structures. In addition, a need has arisen for such a downhole fluid flow control system that has the sensitivity to operate responsive to minor fluid property differences. Further, a need has arisen for such a downhole fluid flow control system that is operable to highly restrict or shut off the production of unwanted fluid flow though the main flow path.

SUMMARY

The present disclosures describes a downhole fluid flow control system that is operable to independently control the inflow of production fluids from multiple production intervals without the requirement for well intervention as the composition of the fluids produced into specific intervals changes over time. In addition, the present disclosures describes a downhole fluid flow control system that does not require the use of biasing devices, intricate components or complex structures. The present disclosures also describes a downhole fluid flow control system that has the sensitivity to operate responsive to minor fluid property differences. Further, the present disclosures describes a downhole fluid flow control system that is operable to highly restrict or shut off the production of unwanted fluid flow though the main flow path.

In a first aspect, the present disclosure is directed to a downhole fluid flow control system. The system includes a fluid control module having a main fluid pathway; a valve element disposed within the fluid control module, the valve element having a first position wherein fluid flow through the main fluid pathway is allowed and a second position wherein fluid flow through the main fluid pathway is prevented; and a pressure sensing module including a secondary fluid pathway in parallel with the main fluid pathway, the pressure sensing module having an upstream pressure sensing location and a downstream pressure sensing location with a cross sectional area transition region therebetween. The valve element is moved between the first and second positions responsive to a pressure difference between pressure signals from the upstream and downstream pressure sensing locations. The pressure difference is dependent upon the change in cross sectional area and the viscosity of a fluid flowing through the secondary fluid pathway such that the viscosity of the fluid is operable to control fluid flow through the main fluid pathway.

In embodiments of the present disclosure, the cross sectional area of the secondary fluid pathway may be larger at the downstream pressure sensing location than at the upstream pressure sensing location. In some embodiments, a ratio of the cross sectional area of the secondary fluid pathway at the downstream pressure sensing location and the upstream pressure sensing location may be between about 2 to 1 and about 10 to 1. In certain embodiments, the pressure difference may be determined by comparing a static pressure signal from the upstream pressure sensing location with a static pressure signal from the downstream pressure sensing location. In other embodiments, the pressure difference may be determined by comparing the static pressure signal from the upstream pressure sensing location with the total pressure signal from the downstream pressure sensing location. In some embodiments, the secondary fluid pathway may be tuned to enhance viscous losses such as by positioning one or more viscosity sensitive flow restrictors in the secondary fluid pathway between the upstream pressure sensing location and the downstream pressure sensing location.

In embodiments of the present disclosure, a fluid flowrate ratio between the main fluid pathway and the secondary fluid pathway may be between about 20 to 1 and about 100 to 1. In certain embodiments, the fluid flowrate ratio between the main fluid pathway and the secondary fluid pathway may be greater than 50 to 1. In some embodiments, the valve element may have at least one third position between the first and second positions wherein fluid flow through the main fluid pathway is choked responsive to the pressure difference. The fluid control module of the present disclosure may have an injection mode, wherein the pressure difference between the pressure signals from the upstream and downstream pressure sensing locations created by an outflow of injection fluid shifts the valve element to the first position, and a production mode, wherein the pressure difference between the pressure signals from the upstream and downstream pressure sensing locations created by an inflow of production fluid shifts the valve element to the second position. Alternatively or additionally, the fluid control module of the present disclosure may have a first production mode, wherein the pressure difference between the pressure signals from the upstream and downstream pressure sensing locations created by an inflow of a desired fluid shifts the valve element to the first position, and a second production mode, wherein the pressure difference between the pressure signals from the upstream and downstream pressure sensing locations created by an inflow of an undesired fluid shifts the valve element to the second position.

In a second aspect, the present disclosure is directed to a flow control screen. The flow control screen includes a base pipe with an internal passageway; a filter medium positioned around the base pipe; a housing positioned around the base pipe defining a fluid flow path between the filter medium and the internal passageway; and at least one fluid control module having a main fluid pathway, a valve element disposed within the fluid control module, the valve element having a first position wherein fluid flow through the main fluid pathway is allowed and a second position wherein fluid flow through the main fluid pathway is prevented and a pressure sensing module including a secondary fluid pathway in parallel with the main fluid pathway, the pressure sensing module having an upstream pressure sensing location and a downstream pressure sensing location with a cross sectional area transition region therebetween. The valve element is moved between the first and second positions responsive to a pressure difference between pressure signals from the upstream and downstream pressure sensing locations. The pressure difference is dependent upon the change in cross sectional area and the viscosity of a fluid flowing through the secondary fluid pathway such that the viscosity of the fluid is operable to control fluid flow through the main fluid pathway.

In a third aspect, the present disclosure is directed to a downhole fluid flow control method. The method includes positioning a fluid flow control system at a target location downhole, the fluid flow control system including a fluid control module having a main fluid pathway, a valve element and a pressure sensing module including a secondary fluid pathway in parallel with the main fluid pathway, the pressure sensing module having an upstream pressure sensing location and a downstream pressure sensing location with a cross sectional area transition region therebetween; producing a desired fluid through the fluid control module; generating a first pressure difference between pressure signals from the upstream and downstream pressure sensing locations that biases the valve element toward a first position wherein fluid flow through the main fluid pathway is allowed; producing an undesired fluid through the fluid control module; and generating a second pressure difference between pressure signals from the upstream and downstream pressure sensing locations that shifts the valve element from the first position to a second position wherein fluid flow through the main fluid pathway is prevented.

In a fourth aspect, the present disclosure is directed to a downhole fluid flow control system. The system includes a fluid control module having a main fluid pathway; a valve element disposed within the fluid control module, the valve element having a first position wherein fluid flow through the main fluid pathway is allowed and a second position wherein fluid flow through the main fluid pathway is prevented; and a pressure sensing module including a secondary fluid pathway tuned to enhance viscous losses that is in parallel with the main fluid pathway, the pressure sensing module having an upstream pressure sensing location and a downstream pressure sensing location. The valve element is moved between the first and second positions responsive to a pressure difference between pressure signals from the upstream and downstream pressure sensing locations. The pressure difference is dependent upon the viscosity of a fluid flowing through the secondary fluid pathway such that the viscosity of the fluid is operable to control fluid flow through the main fluid pathway.

In a fifth aspect, the present disclosure is directed to a downhole fluid flow control system. The system includes a fluid control module having a main fluid pathway; a valve element disposed within the fluid control module, the valve element having a first position wherein fluid flow through the main fluid pathway is allowed and a second position wherein fluid flow through the main fluid pathway is prevented; and a pressure sensing module including a secondary fluid pathway in parallel with the main fluid pathway, the pressure sensing module having an upstream pressure sensing location and a downstream pressure sensing location with at least one flow restrictor positioned therebetween, the at least one flow restrictor being sensitive to viscosity. The valve element is moved between the first and second positions responsive to a pressure difference between pressure signals from the upstream and downstream pressure sensing locations. The pressure difference is dependent upon the viscosity of a fluid flowing through the secondary fluid pathway such that the viscosity of the fluid is operable to control fluid flow through the main fluid pathway.

In a sixth aspect, the present disclosure is directed to a downhole fluid flow control system. The system includes a fluid control module having a main fluid pathway; a valve element disposed within the fluid control module, the valve element having a first position wherein fluid flow through the main fluid pathway is allowed and a second position wherein fluid flow through the main fluid pathway is prevented; and a pressure sensing module including a secondary fluid pathway in parallel with the main fluid pathway, the pressure sensing module having an upstream pressure sensing location, a midstream pressure sensing location and a downstream pressure sensing location, a first flow restrictor having a first sensitivity to viscosity is positioned between the upstream and the midstream pressure sensing locations, a second flow restrictor having a second sensitivity to viscosity is positioned between the midstream and the downstream pressure sensing locations. The valve element is moved between the first and second positions responsive to a pressure difference between pressure signals from the midstream pressure sensing location and a combination of the upstream and downstream pressure sensing locations. The pressure difference is dependent upon the viscosity of a fluid flowing through the secondary fluid pathway such that the viscosity of the fluid is operable to control fluid flow through the main fluid pathway.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While various system, method and other embodiments are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure.

Figure 1:
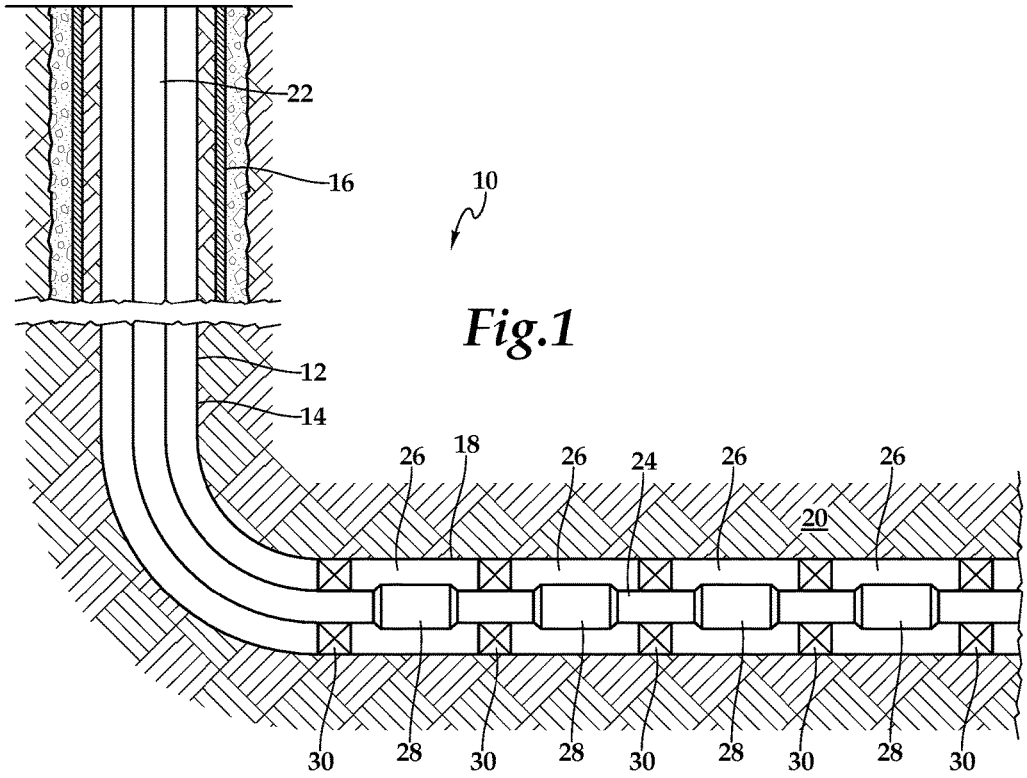
FIG. 1 is a schematic illustration of a well system operating a plurality of flow control screens according to an embodiment of the present disclosure.

Referring initially to FIG. 1, therein is depicted a well system including a plurality of downhole fluid flow control systems positioned in flow control screens embodying principles of the present disclosure that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string 24 that has been installed in wellbore 12 and divides the completion interval into various production intervals 26 adjacent to formation 20. Completion string 24 includes a plurality of flow control screens 28, each of which is positioned between a pair of annular barriers depicted as packers 30 that provides a fluid seal between completion string 24 and wellbore 12, thereby defining production intervals 26. In the illustrated embodiment, flow control screens 28 serve the function of filtering particulate matter out of the production fluid stream as well as providing autonomous flow control of fluids flowing therethrough based upon a fluid property, such as the viscosity, of the fluid.

For example, the flow control sections of flow control screens 28 may be operable to control the flow of a production fluid stream during the production phase of well operations. Alternatively or additionally, the flow control sections may be operable to control the flow of an injection fluid stream during a treatment phase of well operations. As explained in greater detail below, the flow control sections preferably control the inflow of production fluids into each production interval without the requirement for well intervention as the composition of the fluids produced into specific intervals changes over time in order to maximize production of a desired fluid, such as oil, and minimize production of an undesired fluid, such as water or gas.

Even though FIG. 1 depicts the flow control screens of the present disclosure in an open hole environment, it should be understood by those skilled in the art that the present flow control screens are equally well suited for use in cased wells. Also, even though FIG. 1 depicts one flow control screen in each production interval, it should be understood by those skilled in the art that any number of flow control screens may be deployed within a production interval without departing from the principles of the present disclosure. In addition, even though FIG. 1 depicts the flow control screens in a horizontal section of the wellbore, it should be understood by those skilled in the art that the present flow control screens are equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Further, even though the flow control systems in FIG. 1 have been described as being associated with flow control screens in a tubular string, it should be understood by those skilled in the art that the flow control systems of the present disclosure need not be associated with a screen or be deployed as part of the tubular string. For example, one or more flow control systems may be deployed and removably inserted into the center of the tubing string or inside pockets of the tubing string.

Figure 2:
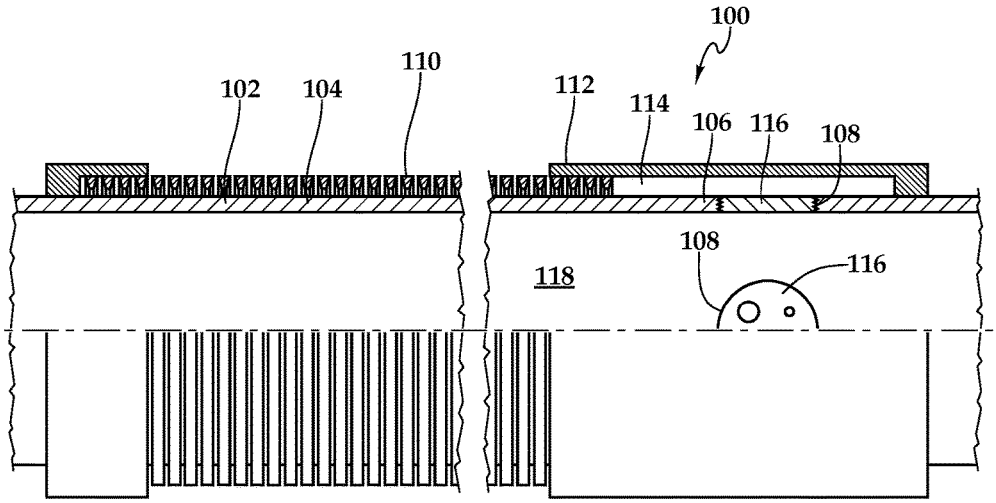
FIG. 2 is a quarter sectional view of a flow control screen including a downhole fluid flow control system according to an embodiment of the present disclosure.

Referring next to FIG. 2, therein is depicted a flow control screen according to the present disclosure that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108. Positioned around an uphole portion of blank pipe section 104 is a screen element or filter medium 110, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the present disclosure does not need to have a filter medium associated therewith, accordingly, the exact design of the filter medium is not critical to the present disclosure.

Positioned downhole of filter medium 110 is an outer housing 112 that forms an annulus 114 with base pipe 102. At its downhole end, outer housing 112 is securably connected to base pipe 102. The various connections of the components of flow control screen 100 may be made in any suitable fashion including welding, threading and the like as well as through the use of fasteners such as pins, set screws and the like. Threadably coupled within production ports 108 are a plurality of fluid control modules 116. Even though the fluid control modules in FIG. 2 have been described and depicted as being threadably coupled within the production ports of a base pipe, it will be understood by those skilled in the art that the fluid control modules of the present disclosure may be alternatively positioned such as between the base pipe and the outer housing or within the base pipe so long as the fluid control modules are in the flow path between the formation and the interior flow path of the base pipe. In the illustrated embodiment, fluid control modules 116 are circumferentially distributed about base pipe 102 at ninety degree intervals such that four fluid control modules 116 are provided, only two being partially visible in the figure. Even though a particular arrangement of fluid control modules 116 has been described, it should be understood by those skilled in the art that other numbers and arrangements of fluid control modules 116 may be used. For example, either a greater or lesser number of circumferentially distributed fluid control modules 116 at uniform or nonuniform intervals may be used. Additionally or alternatively, fluid control modules 116 may be longitudinally distributed along base pipe 102.

Fluid control modules 116 may be operable to control the flow of fluid in either direction therethrough. For example, during the production phase of well operations, fluid flows from the formation into the production tubing through fluid flow control screen 100. The production fluid, after being filtered by filter medium 110, if present, flows into annulus 114. The fluid then enters one or more inlets of fluid control modules 116 where the desired flow operation occurs depending upon the composition of the produced fluid. For example, if a desired fluid such as oil is produced, flow through fluid control modules 116 is allowed. If an undesired fluid such as water or gas is produced, flow through fluid control modules 116 is restricted or prevented. In the case of producing a desired fluid, the fluid is discharged through fluid control modules 116 to interior flow path 118 of base pipe 102 for production to the surface.

As another example, during the treatment phase of well operations, a treatment fluid may be pumped downhole from the surface in interior flow path 118 of base pipe 102. In this case, the treatment fluid then enters fluid control modules 116 where the desired flow control operation occurs including providing open injection pathways. The fluid then travels into annular region 114 between base pipe 102 and outer housing 112 before passing through filter medium 110 for injection into the surrounding formation. When production begins and fluid enters fluid control modules 116 from annular region 114, the desired flow operation occurs and the injection pathways are restricted or closed. In certain embodiments, fluid control modules 116 may be used to bypass filter medium 110 entirely during injection operations.

Figure 3A:
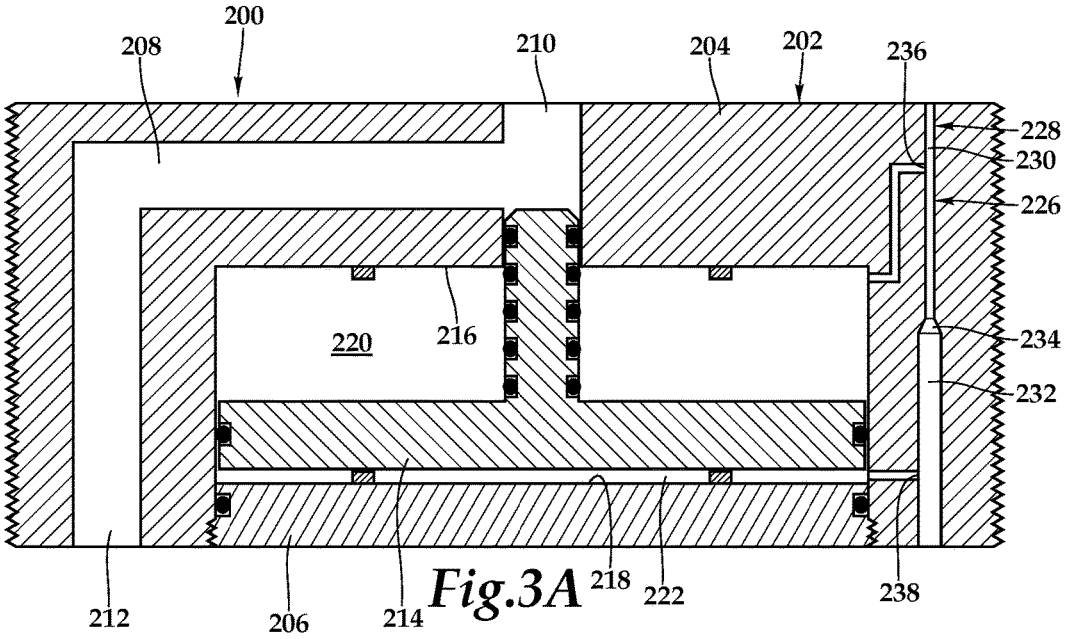
FIGS. 3A-3B are cross sectional views of a downhole fluid flow control system according to an embodiment of the present disclosure in its open and closed positions.
Figure 3B:
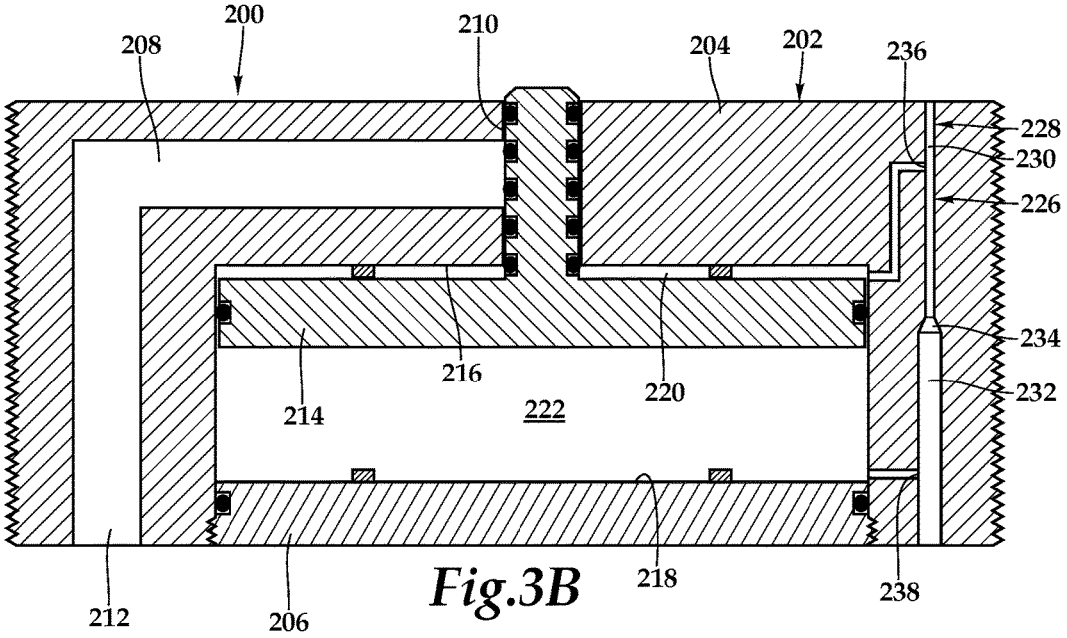

Referring next to FIGS. 3A-3B, a downhole fluid flow control system according to an embodiment of the present disclosure in its open and closed positions is representatively illustrated and generally designated 200. Fluid flow control system 200 includes a fluid control module 202 having an outer housing member 204 and a housing cap 206 that is threadedly and sealingly coupled to outer housing member 204. Fluid control module 202 defines a main fluid pathway 208 having an inlet 210 and one or more outlets 212. In one embodiment, main fluid pathway 208 has multiple branches downstream of inlet 210 such as three branches resulting in three outlets 212. It should be understood by those skilled in the art that main fluid pathway 208 may have an number of designs with any number of branches and outlets both greater than or less than three. A valve element 214 is sealably received within fluid control module 202. Valve element 214 is disposed between a lower surface 216 of outer housing member 204 and an upper surface 218 of housing cap 206. Valve element 214 defines an upper pressure chamber 220 with lower surface 216 of outer housing member 204 and a lower pressure chamber 222 with upper surface 218 of housing cap 206.

As can be seen by comparing FIGS. 3A and 3B, valve element 214 is operable for movement within fluid control module 202 and is depicted in its fully open position in FIG. 3A and its fully closed position in FIG. 3B. It should be noted by those skilled in the art that valve element 214 also has a plurality of choking positions between the fully open and fully closed positions. Valve element 214 is operated responsive to differential pressure between upper pressure chamber 220 and lower pressure chamber 222. For example, when the pressure in upper pressure chamber 220 is higher than the pressure in lower pressure chamber 222, valve element 214 is biased toward the valve open position depicted in FIG. 3A. Likewise, when the pressure in upper pressure chamber 220 is lower than the pressure in lower pressure chamber 222, valve element 214 is biased toward the valve closed position depicted in FIG. 3B. The differential pressure between upper pressure chamber 220 and lower pressure chamber 222 is established by pressure sensing module 226. Pressure sensing module 226 includes a secondary fluid pathway 228 that is in parallel with main fluid pathway 208. As used herein, the term parallel with mean that secondary fluid pathway 228 and main fluid pathway 208 share a common fluid origination location, for example the formation, and a common fluid destination location, for example the interior flow path of the base pipe. Accordingly, secondary fluid pathway 228 and main fluid pathway 208 may or may not be in direct fluid communication with each other. Likewise, secondary fluid pathway 228 and main fluid pathway 208 may share a common inlet but not a common outlet or may share a common outlet but not a common inlet.

Pressure sensing module 226 includes an upstream flow path 230, a downstream flow path 232 with a cross sectional area transition region 234 therebetween. In the illustrated embodiment, upstream flow path 230 has a cross sectional area that is less than that of downstream flow path 232. For example, the ratio of the cross sectional area of upstream flow path 230 and downstream flow path 232 may be between about 1 to 2 and about 1 to 10. Cross sectional area transition region 234 may have any suitable transitional shape such as conical shape, polynomial shape or similar transitional shape. The fluid flowrate ratio between main fluid pathway 208 and the secondary fluid pathway 228 may be between about 20 to 1 and about 100 to 1 or higher and is preferably greater than 50 to 1. Pressure sensing module 226 includes an upstream pressure sensing location 236 and a downstream pressure sensing location 238. In the illustrated embodiment, a pressure signal is communicated from upstream pressure sensing location 236 to upper pressure chamber 220 and a pressure signal is communicated from downstream pressure sensing location 238 to lower pressure chamber 222.

The operation of downhole fluid flow control system 200 will now be described with reference to FIGS. 3A-3B and FIGS. 4A-4D. During the production phase of well operations, fluid flows from the formation into the production tubing through fluid flow control system 200. The main fluid flow enters inlet 210 of fluid control module 202, travels through main fluid pathway 208 and exits into the interior of the base pipe via outlets 212. At the same time, secondary fluid flow enters secondary fluid pathway 228 passing through upstream flow path 230, cross sectional area transition region 234 and downstream flow path 232 before exiting into the interior of the base pipe. As secondary fluid flow passes through secondary fluid pathway 228 a pressure signal is communicated from upstream pressure sensing location 236 to upper pressure chamber 220 and a pressure signal is communicated from downstream pressure sensing location 238 to lower pressure chamber 222. In the illustrated embodiment, if the pressure signal from upstream pressure sensing location 236 is greater than the pressure signal from downstream pressure sensing location 238, valve element 214 is biased toward the valve open position depicted in FIG. 3A. Likewise, if the pressure signal from upstream pressure sensing location 236 is less than the pressure signal from downstream pressure sensing location 238, valve element 214 is biased toward the valve closed position depicted in FIG. 3B.

Figure 4A:
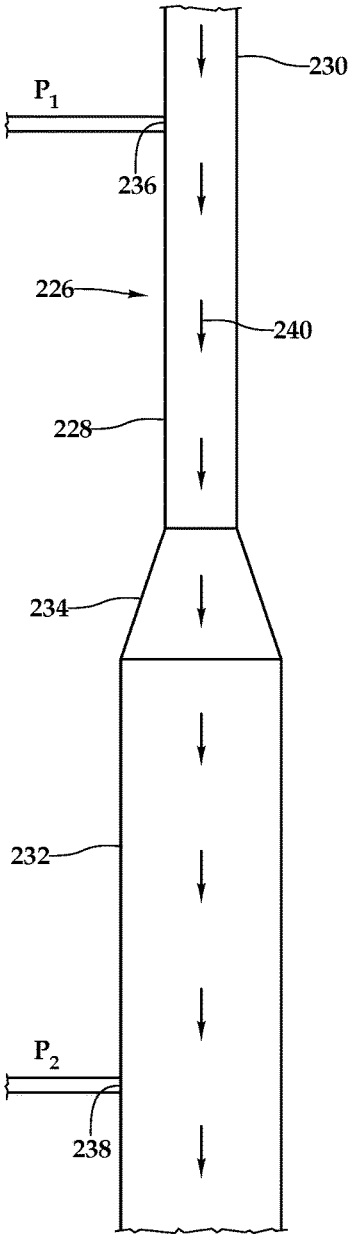
FIG. 4A is a schematic illustration of a pressure sensing module for use in a downhole fluid flow control system according to an embodiment of the present disclosure.
Figure 4B:
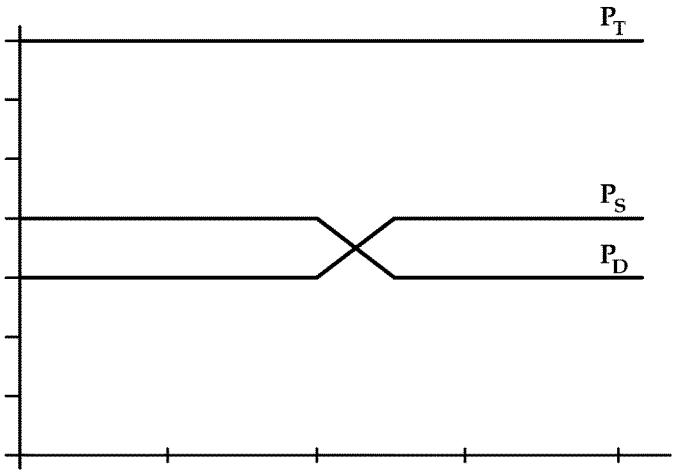
FIGS. 4B-4D are pressure versus distance graphs showing static pressure, dynamic pressure and total pressure curves.

As best seen in FIG. 4A, arrows 240 depict fluid flow through secondary fluid pathway 228. According to Bernoulli principals, the sum of the static pressure $P_S$, the dynamic pressure $P_D$ and the gravitation term should be constant and is referred to herein as the total pressure $P_T$. In the present case, the gravitational term is negligible due to low elevation change. FIG. 4B is a pressure versus distance graph illustrating an idealized case of fluid flowing through secondary fluid pathway 228. As illustrated, the total pressure $P_T$ remains constant. Dynamic pressure $P_D$ is constant in upstream flow path 230 and downstream flow path 232 but decreases as the fluid loses velocity through cross sectional area transition region 234. Static pressure $P_S$ is constant in upstream flow path 230 and downstream flow path 232 but increases as the fluid loses velocity through cross sectional area transition region 234.

Figure 4C:
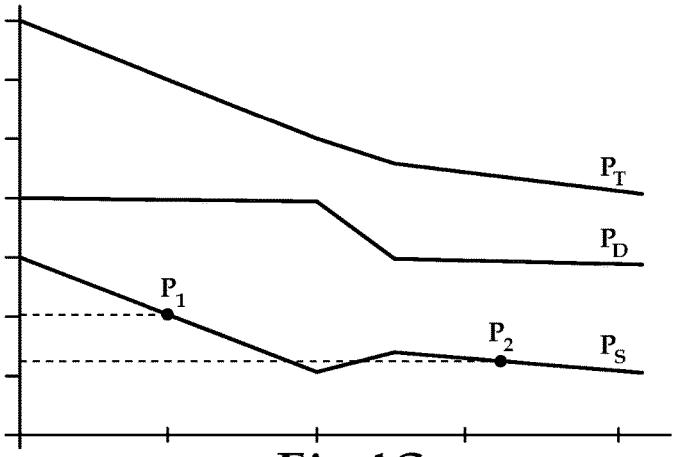

FIG. 4C is a pressure versus distance graph illustrating a case in which viscous losses associated with the fluid flowing through secondary fluid pathway 228 are taken into consideration. Viscous losses are a function of fluid properties including viscosity and density as well as flow properties such as velocity. As illustrated, a relatively high viscosity fluid such as oil is flowing through secondary fluid pathway 228. In this case, the total pressure $P_T$ decreases in upstream flow path 230, cross sectional area transition region 234 and downstream flow path 232. Dynamic pressure $P_D$ is substantially constant in upstream flow path 230 and downstream flow path 232 but decreases as the fluid loses velocity through cross sectional area transition region 234. Static pressure $P_S$ decreases in upstream flow path 230 and downstream flow path 232 but increases as the fluid loses velocity through cross sectional area transition region 234. Even with the pressure recovery in static pressure $P_S$ resulting from the decreased velocity of the fluid in cross sectional area transition region 234, a static pressure signal $P_1$ at upstream pressure sensing location 236 is greater than a static pressure signal $P_2$ at downstream pressure sensing location 238. Accordingly, the pressure in upper pressure chamber 220 is higher than the pressure in lower pressure chamber 222 and valve element 214 is biased toward the valve open position depicted in FIG. 3A. In this example, when the fluid flowing through secondary fluid pathway 228 is a relatively high viscosity fluid, such as oil, valve element 214 remains open and fluid production through fluid flow control system 200 is allowed.

Figure 4D:
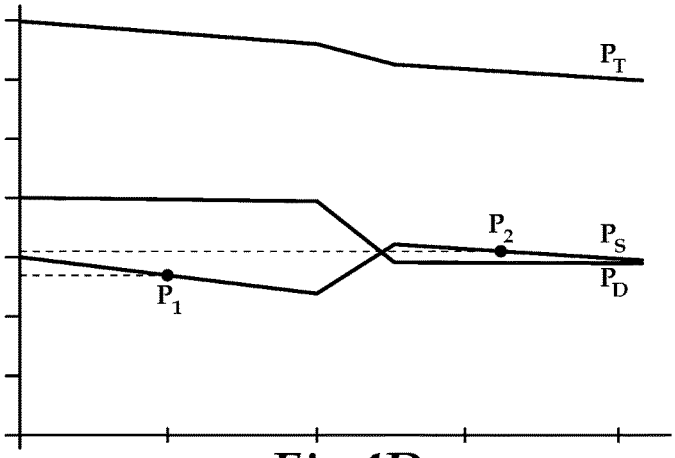

FIG. 4D is a pressure versus distance graph illustrating another case in which viscous losses associated with the fluid flowing through secondary fluid pathway 228 are taken into consideration. As illustrated, a relatively low viscosity fluid such as water or gas is flowing through secondary fluid pathway 228. In this case, the total pressure $P_T$ decreases in upstream flow path 230, cross sectional area transition region 234 and downstream flow path 232 but to a lesser degree than when the higher viscosity fluid described above is flowing through secondary fluid pathway 228. Dynamic pressure $P_D$ is substantially constant in upstream flow path 230 and downstream flow path 232 but decreases as the fluid loses velocity through cross sectional area transition region 234. Static pressure $P_S$ decreases in upstream flow path 230 and downstream flow path 232 but increases as the fluid loses velocity through the cross sectional area transition region 234. In this case, with the pressure recovery in static pressure $P_S$ resulting from the decreased velocity of the fluid in cross sectional area transition region 234, the static pressure signal $P_1$ at upstream pressure sensing location 236 is less than the static pressure signal $P_2$ at downstream pressure sensing location 238. Accordingly, the pressure in upper pressure chamber 220 is lower than the pressure in lower pressure chamber 222 and valve element 214 is biased toward the valve closed position depicted in FIG. 3B. In this example, when the fluid flowing through secondary fluid pathway 228 is a relatively low viscosity fluid, such as water or gas, valve element 214 is biased toward the valve closed position, thereby restricting or preventing fluid production through fluid flow control system 200.

In this manner, using an upstream static pressure signal and a downstream static pressure signal from a pressure sensing module having a cross sectional area transition region therebetween enables autonomous operation of a valve element as the fluid viscosity changes to enable production of a desired fluid, such as oil, though the main flow path while restricting or shutting off the production of an undesired fluid, such as water or gas, though a main flow path of a fluid control system. Even though the present example has described the wanted fluid as oil and the unwanted fluid as water or gas, the fluid flow control systems of the present disclosure can alternatively be configured allow a lower viscosity fluid such as gas to be produced while restricting or shutting off flow of a higher viscosity fluid such as water by, for example, routing the static pressure signal $P_1$ at upstream pressure sensing location 236 to lower pressure chamber 222 and routing the static pressure signal $P_2$ at downstream pressure sensing location 238 to upper pressure chamber 220. As another alternative, the fluid flow control systems of the present disclosure can be configured allow the production of heavy crude oil or bitumen, the desired fluid, while restricting or shutting off the production of steam, the undesired fluid, in, for example, a steam assisted gravity drainage operation.

Figure 5:
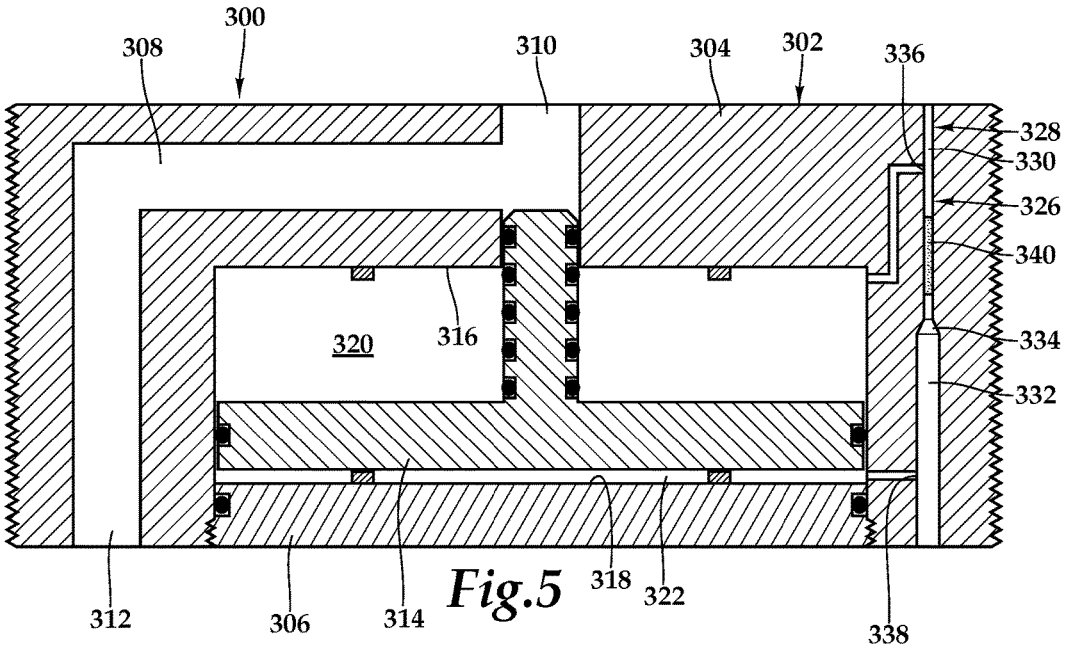
FIG. 5 is a cross sectional view of a downhole fluid flow control system according to an embodiment of the present disclosure.

Referring next to FIG. 5, a downhole fluid flow control system according to an embodiment of the present disclosure is representatively illustrated and generally designated 300. Fluid flow control system 300 includes a fluid control module 302 having an outer housing member 304 and a housing cap 306 that is threadedly and sealingly coupled to outer housing member 304. Fluid control module 302 defines a main fluid pathway 308 having an inlet 310 and one or more outlets 312. A valve element 314 is sealably received within fluid control module 302 between a lower surface 316 of outer housing member 304 and an upper surface 318 of housing cap 306. Valve element 314 defines an upper pressure chamber 320 with lower surface 316 of outer housing member 304 and a lower pressure chamber 322 with upper surface 318 of housing cap 306. Valve element 314 is operable for movement within fluid control module 302 between the depicted fully open position and a fully closed position as well as a plurality of choking positions therebetween. Valve element 314 is operated responsive to differential pressure between upper pressure chamber 320 and lower pressure chamber 322 which is established by pressure sensing module 326.

Pressure sensing module 326 includes a secondary fluid pathway 328 that is in parallel with main fluid pathway 308 and includes an upstream flow path 330 and a downstream flow path 332 with a cross sectional area transition region 334 therebetween. In the illustrated embodiment, upstream flow path 330 has a cross sectional area that is less than that of downstream flow path 332. Pressure sensing module 326 includes an upstream pressure sensing location 336 and a downstream pressure sensing location 338. Disposed within secondary fluid pathway 328 between upstream and downstream pressure sensing locations 336, 338 is a flow restrictor 340 that is operable to amplify the effect of a fluid property change. For example, flow restrictor 340 may be a viscosity sensitive element that increases the sensitivity of pressure sensing module 326 to changes in the viscosity of the fluid flowing therethrough. In this example, flow restrictor 340 may including a torturous path element such as a plurality of small diameter tubes or a matrix chamber including foam, beads or other porous filler material. In the illustrated embodiment, a first pressure signal is communicated from upstream pressure sensing location 336 to upper pressure chamber 320 and a second pressure signal is communicated from downstream pressure sensing location 338 to lower pressure chamber 322.

The operation of downhole fluid flow control system 300 will now be described. During the production phase of well operations, fluid flows from the formation into the production tubing through fluid flow control system 300. The main fluid flow enters inlet 310 of fluid control module 302, travels through main fluid pathway 308 and exits into the interior of the base pipe via outlets 312. At the same time, secondary fluid flow enters secondary fluid pathway 328 passing through upstream flow path 330, flow restrictor 340, cross sectional area transition region 334 and downstream flow path 332 before exiting into the interior of the base pipe. As secondary fluid flow passes through secondary fluid pathway 328, a static pressure $P_S$ signal is communicated from upstream pressure sensing location 336 to upper pressure chamber 320 and a static pressure $P_S$ signal is communicated from downstream pressure sensing location 338 to lower pressure chamber 322. In the illustrated embodiment, if the static pressure $P_S$ signal from upstream pressure sensing location 336 is greater than the static pressure $P_S$ signal from downstream pressure sensing location 338, valve element 314 is biased toward the valve open position. Likewise, if the static pressure $P_S$ signal from upstream pressure sensing location 336 is less than the static pressure $P_S$ signal from downstream pressure sensing location 338, valve element 314 is biased toward the valve closed position.

In the case of a relatively high viscosity fluid such as oil flowing through secondary fluid pathway 328, the static pressure $P_S$ decreases in upstream flow path 330 with a significant decrease at flow restrictor 340, decreases in downstream flow path 332 but increases as the fluid loses velocity through cross sectional area transition region 334. Even with the pressure recovery in static pressure $P_S$ resulting from the decreased velocity of the fluid in cross sectional area transition region 334, a static pressure signal at upstream pressure sensing location 336 is greater than a static pressure signal at downstream pressure sensing location 338, thereby biasing valve element 314 toward the valve open position and allowing fluid production through fluid flow control system 300. In the case of a relatively low viscosity fluid such as water or gas flowing through secondary fluid pathway 328, the static pressure $P_S$ decreases in upstream flow path 230 with little added effect at flow restrictor 340, decreases in downstream flow path 332 but increases as the fluid loses velocity through the cross sectional area transition region 334. With the pressure recovery in static pressure $P_S$ resulting from the decreased velocity of the fluid in cross sectional area transition region 334, the static pressure signal at upstream pressure sensing location 336 is less than the static pressure signal at downstream pressure sensing location 338, thereby biasing valve element 314 toward the valve closed position and restricting or preventing fluid production through fluid flow control system 300. In this manner, using an upstream static pressure signal and a downstream static pressure signal from a pressure sensing module having a viscosity sensitive flow restrictor and a cross sectional area transition region therebetween enables autonomous operation of a valve element as the fluid viscosity changes to enable production of a desired fluid, such as oil, though the main flow path while restricting or shutting off the production of an undesired fluid, such as water or gas, though the main flow path of a downhole fluid flow control system.

Figure 6:
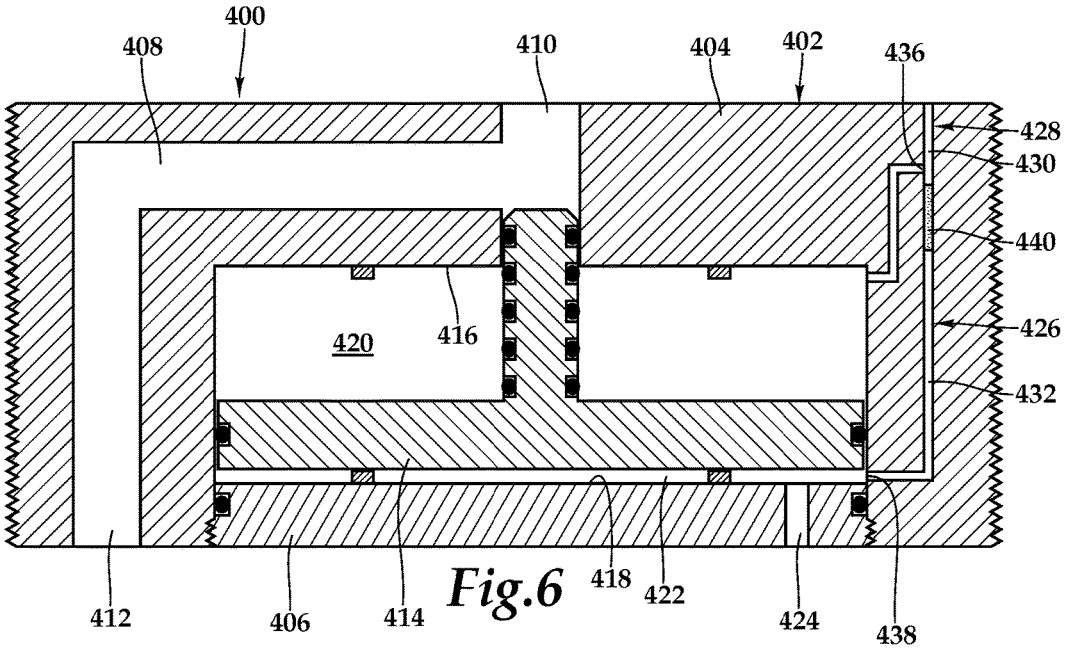
FIG. 6 is a cross sectional view of a downhole fluid flow control system according to an embodiment of the present disclosure.

Referring next to FIG. 6, a downhole fluid flow control system according to an embodiment of the present disclosure is representatively illustrated and generally designated 400. Fluid flow control system 400 includes a fluid control module 402 having an outer housing member 404 and a housing cap 406 that is threadedly and sealingly coupled to outer housing member 404. Fluid control module 402 defines a main fluid pathway 408 having an inlet 410 and one or more outlets 412. A valve element 414 is sealably received within fluid control module 402 between a lower surface 416 of outer housing member 404 and an upper surface 418 of housing cap 406. Valve element 414 defines an upper pressure chamber 420 with lower surface 416 of outer housing member 404 and a lower pressure chamber 422 with upper surface 418 of housing cap 406. In the illustrated embodiment, lower pressure chamber 422 has one or more outlets 424 through housing cap 406. Valve element 414 is operable for movement within fluid control module 402 between the depicted fully open position and a fully closed position as well as a plurality of choking positions therebetween. Valve element 414 is operated responsive to differential pressure between upper pressure chamber 420 and lower pressure chamber 422 which is established by pressure sensing module 426.

Pressure sensing module 426 includes a secondary fluid pathway 428 that is in parallel with main fluid pathway 408 and includes an upstream flow path 430 and a downstream flow path 432. Preferably, secondary fluid pathway 428 is tuned to enhance viscous losses. In the illustrated embodiment, this is achieved using a viscosity sensitive flow restrictor 440. Pressure sensing module 426 includes an upstream pressure sensing location 436 and has an outlet 438. In the illustrated embodiment, a first pressure signal is communicated from upstream pressure sensing location 436 to upper pressure chamber 420 and a second pressure signal is communicated from outlet 438 to lower pressure 422.

The operation of downhole fluid flow control system 400 will now be described with reference to FIGS. 6 and 7A-7B. During the production phase of well operations, fluid flows from the formation into the production tubing through fluid flow control system 400. The main fluid flow enters inlet 410 of fluid control module 402, travels through main fluid pathway 408 and exits into the interior of the base pipe via outlets 412. At the same time, secondary fluid flow enters secondary fluid pathway 428 passing through upstream flow path 430, viscosity sensitive flow restrictor 440 and downstream flow path 432 before exiting through outlet 438. As secondary fluid flow passes through secondary fluid pathway 428, a static pressure $P_S$ signal is communicated from upstream pressure sensing location 436 to upper pressure chamber 420 and a total pressure $P_T$ signal is communicated from outlet 438 to lower pressure chamber 422. In the illustrated embodiment, if the static pressure $P_S$ signal from upstream pressure sensing location 436 is greater than the total pressure $P_T$ signal from outlet 438, valve element 414 is biased toward the valve open position. Likewise, if the static pressure $P_S$ signal from upstream pressure sensing location 436 is less than the total pressure $P_T$ signal from outlet 438, valve element 414 is biased toward the valve closed position.

Figure 7A:
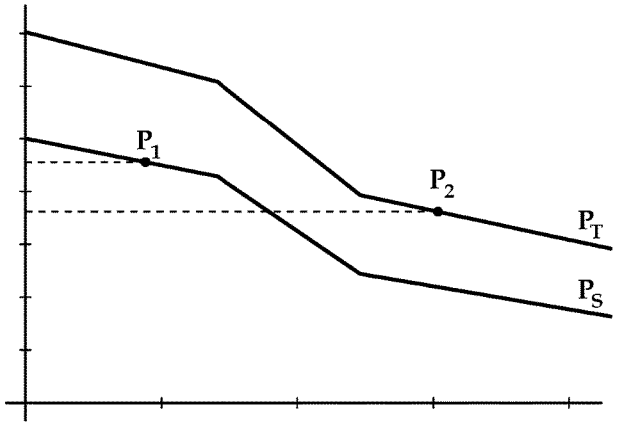
FIGS. 7A-7B are pressure versus distance graphs showing static pressure and total pressure curves.
Figure 7B:
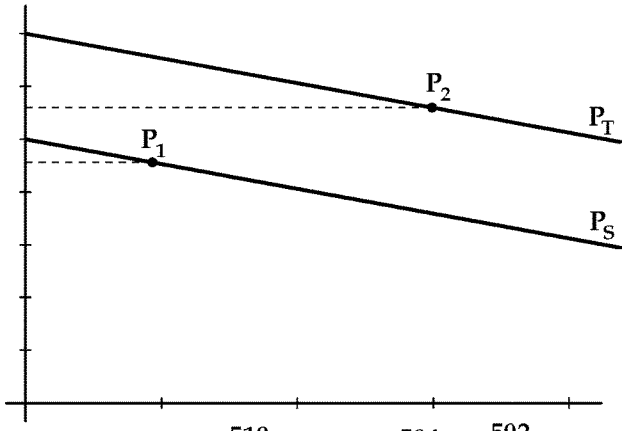

In the case of a relatively high viscosity fluid such as oil flowing through secondary fluid pathway 428, as illustrated in FIG. 7A, both the total pressure $P_T$ and the static pressure $P_S$ decrease in upstream flow path 430, significantly decrease at flow restrictor 440 and decrease in downstream flow path 432. As depicted in the graph, the static pressure signal $P_1$ at upstream pressure sensing location 436 is greater than the total pressure signal $P_2$ at outlet 438, thereby biasing valve element 414 toward the valve open position and allowing fluid production through fluid flow control system 400. In the case of a relatively low viscosity fluid such as water or gas flowing through secondary fluid pathway 428, as illustrated in FIG. 7B, both the total pressure $P_T$ and the static pressure $P_S$ decrease in upstream flow path 430 and in downstream flow path 432 with little added effect at flow restrictor 440. As depicted in the graph, the static pressure signal $P_1$ at upstream pressure sensing location 436 is less than the total pressure signal $P_2$ at outlet 438, thereby biasing valve element 414 toward the valve closed position and restricting or preventing fluid production through fluid flow control system 400. In this manner, using an upstream static pressure signal and a downstream total pressure signal from a pressure sensing module tuned to enhance viscous losses therebetween enables autonomous operation of a valve element as the fluid viscosity changes to enable production of a wanted fluid, such as oil, though the main flow path while restricting or shutting off the production of an unwanted fluid, such as water or gas, though the main flow path of a downhole fluid flow control system.

Figure 8:
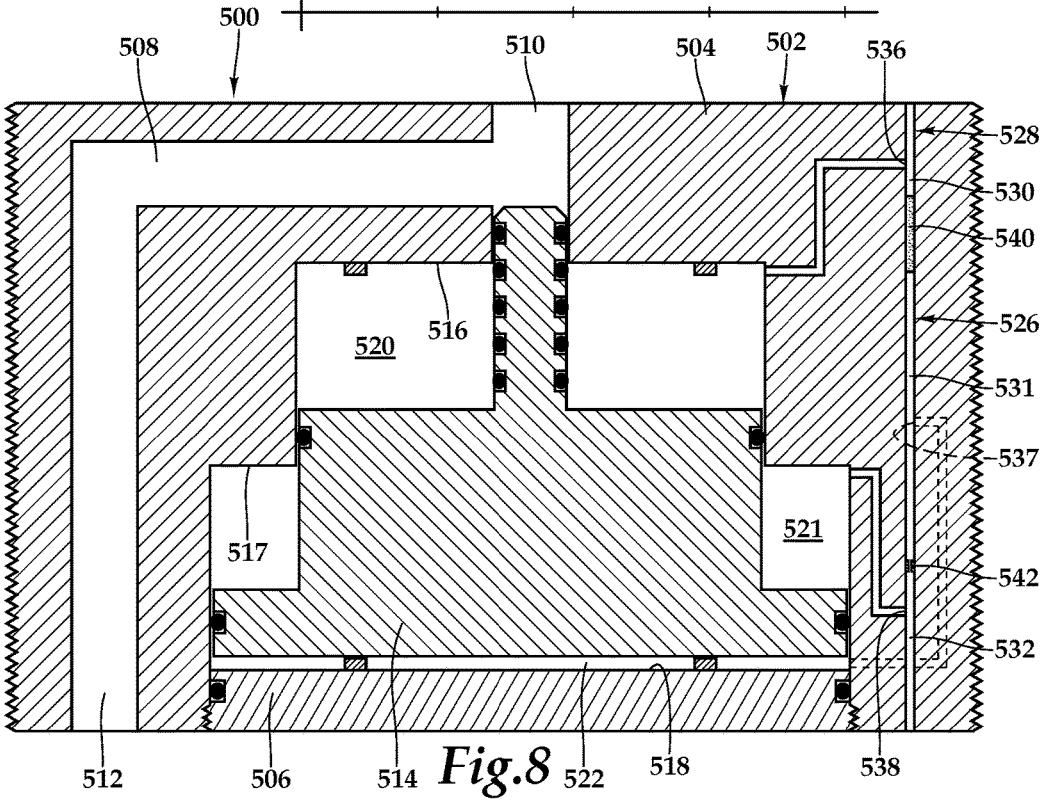
FIG. 8 is a cross sectional view of a downhole fluid flow control system according to an embodiment of the present disclosure.

Referring next to FIG. 8, a downhole fluid flow control system according to an embodiment of the present disclosure is representatively illustrated and generally designated 500. Fluid flow control system 500 includes a fluid control module 502 having an outer housing member 504 and a housing cap 506 that is threadedly and sealingly coupled to outer housing member 504. Fluid control module 502 defines a main fluid pathway 508 having an inlet 510 and one or more outlets 512. A valve element 514 is sealably received within fluid control module 502 between lower surfaces 516, 517 of outer housing member 504 and an upper surface 518 of housing cap 506. Valve element 514 defines an upper pressure chamber 520 with lower surface 516 and a middle pressure chamber 521 with upper surface 517 of outer housing member 504 and a lower pressure chamber 522 with upper surface 518 of housing cap 506. Valve element 514 is operable for movement within fluid control module 502 between the depicted fully open position and a fully closed position as well as a plurality of choking positions therebetween. Valve element 514 is operated responsive to differential pressure between upper and middle pressure chambers 520, 521 and lower pressure chamber 522 which is established by pressure sensing module 526.

Pressure sensing module 526 includes a secondary fluid pathway 528 that is in parallel with main fluid pathway 508 and includes an upstream flow path 530, a midstream flow path 531 and a downstream flow path 532. A flow restrictor 540 is positioned between upstream flow path 530 and midstream flow path 531. A flow restrictor 542 is positioned between midstream flow path 531 and downstream flow path 532. In the illustrated embodiment, flow restrictor 540 is a viscosity sensitive flow restrictor as discussed above and flow restrictor 542 is preferably an orifice or other substantially viscosity independent flow restrictor. In the case of an orifice, the change in fluid pressure thereacross is dependent upon fluid density and the square of the fluid velocity. Pressure sensing module 526 includes an upstream pressure sensing location 536, a midstream pressure sensing location 537 and downstream pressure sensing location 538. In the illustrated embodiment, a first pressure signal is communicated from upstream pressure sensing location 536 to upper pressure chamber 520, a second pressure signal is communicated from midstream pressure sensing location 537 to lower pressure 522 and a third pressure signal is communicated from downstream pressure sensing location 538 to middle pressure chamber 521.

The operation of downhole fluid flow control system 500 will now be described with reference to FIGS. 8 and 9A-9C. During the production phase of well operations, fluid flows from the formation into the production tubing through fluid flow control system 500. The main fluid flow enters inlet 510 of fluid control module 502, travels through main fluid pathway 508 and exits into the interior of the base pipe via outlets 512. At the same time, secondary fluid flow enters secondary fluid pathway 528 passing through upstream flow path 530, flow restrictor 540, midstream flow path 531, flow restrictor 542 and downstream flow path 532 before exiting into the interior of the base pipe. In the illustrated embodiment, as secondary fluid flow passes through secondary fluid pathway 528, a first static pressure $P_S$ signal is communicated from upstream pressure sensing location 536 to upper pressure chamber 520, a second static pressure $P_S$ signal is communicated from midstream pressure sensing location 537 to lower pressure 522 and a third static pressure $P_S$ signal is communicated from downstream pressure sensing location 538 to middle pressure chamber 521. It should be noted by those skilled in the art that static pressure $P_S$, total pressure $P_T$ or a combination thereof may be used for the various pressure signals from upstream, midstream and downstream pressure sensing location 536, 537, 538. In the illustrated embodiment, if the combination of the pressure signals from upstream pressure sensing location 536 and downstream pressure sensing location 538 is greater than the pressure signal from the midstream pressure sensing location 537, valve element 514 is biased toward the valve open position. Likewise, if the combination of the pressure signals from upstream pressure sensing location 536 and downstream pressure sensing location 538 is less than the pressure signal from the midstream pressure sensing location 537, valve element 514 is biased toward the valve closed position.

Figure 9A:
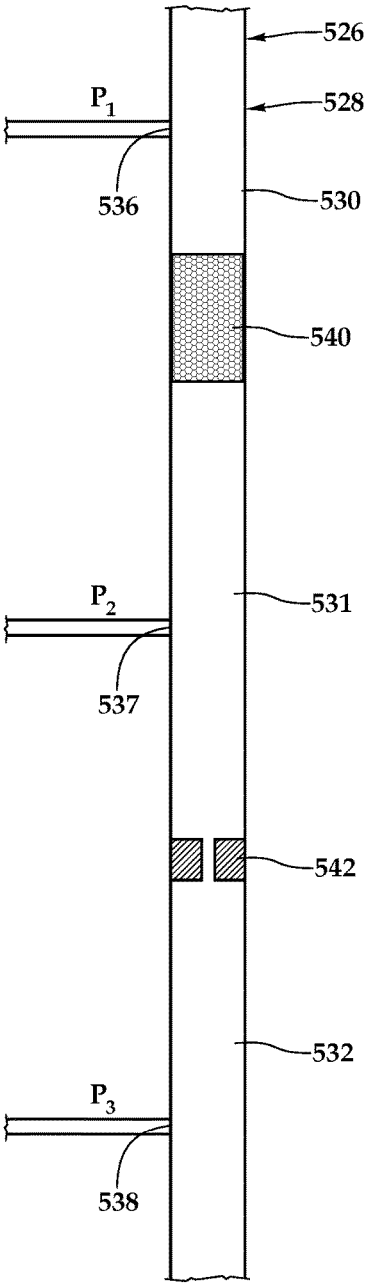
FIG. 9A is a schematic illustration of a pressure sensing module for use in a downhole fluid flow control system according to an embodiment of the present disclosure.
Figure 9B:
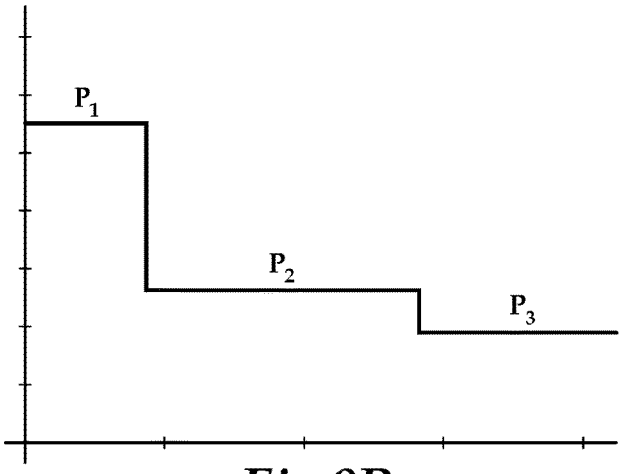
FIGS. 9B-9C are pressure versus distance graphs showing upstream, midstream and downstream pressures.
Figure 9C:
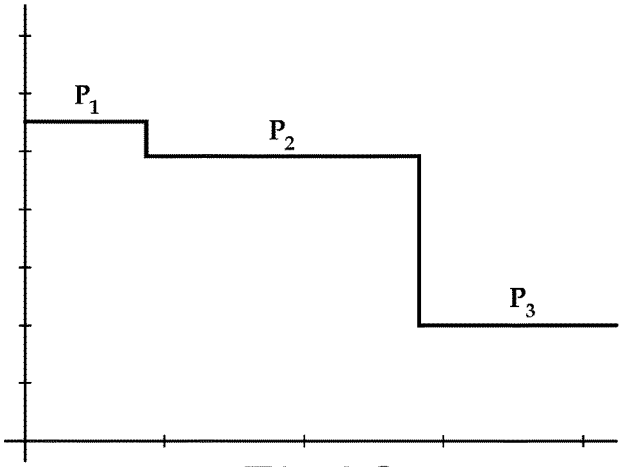

In the case of a relatively high viscosity fluid such as oil flowing through secondary fluid pathway 528, as illustrated in FIG. 9B, the pressure drop across flow restrictor 540 is greater than the pressure drop across flow restrictor 542. As depicted in the graph, the pressure signal $P_1$ at upstream pressure sensing location 536 in combination with the pressure signal $P_3$ at downstream pressure sensing location 538 is greater than the pressure signal $P_2$ at the midstream pressure sensing location 537, thereby biasing valve element 514 toward the valve open position and allowing fluid production through fluid flow control system 500. In the case of a relatively low viscosity fluid such as water or gas flowing through secondary fluid pathway 528, as illustrated in FIG. 9C, the pressure drop across flow restrictor 540 is less than the pressure drop across flow restrictor 542. As depicted in the graph, the pressure signal $P_1$ at upstream pressure sensing location 536 in combination with the pressure signal $P_3$ at downstream pressure sensing location 538 is less than the pressure signal $P_2$ at the midstream pressure sensing location 537, thereby biasing valve element 514 toward the valve closed position and restricting or preventing fluid production through fluid flow control system 500. In this manner, using an upstream pressure signal, a midstream pressure signal and a downstream pressure signal from a pressure sensing module having respective flow restrictors therebetween enables autonomous operation of a valve element as the fluid viscosity changes to enable production of a desired fluid, such as oil, though the main flow path while restricting or shutting off the production of an undesired fluid, such as water or gas, though the main flow path of a downhole fluid flow control system.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole fluid flow control system comprising:

a fluid control module having a main fluid pathway;

a valve element disposed within the fluid control module, the valve element having a first position wherein fluid flow through the main fluid pathway is allowed and a second position wherein fluid flow through the main fluid pathway is prevented; and a pressure sensing module including a secondary fluid pathway in parallel with the main fluid pathway, the pressure sensing module having an upstream pressure sensing location, a midstream pressure sensing location and a downstream pressure sensing location, a first flow restrictor having a first sensitivity to viscosity is positioned between the upstream and the midstream pressure sensing locations, a second flow restrictor having a second sensitivity to viscosity is positioned between the midstream and the downstream pressure sensing locations;

wherein the valve element is moved between the first and second positions responsive to a pressure difference between pressure signals from the midstream pressure sensing location and a combination of the upstream and downstream pressure sensing locations; and wherein the pressure difference is dependent upon the viscosity of a fluid flowing through the secondary fluid pathway such that the viscosity of the fluid is operable to control fluid flow through the main fluid pathway.

2. The flow control system as recited in claim 1 wherein one of the first and second flow restrictors is a viscosity sensitive flow restrictor and the other of the first and second flow restrictors is a substantially viscosity independent flow restrictor.

3. The flow control system as recited in claim 2 wherein the viscosity sensitive flow restrictor is selected from the group consisting of a torturous path element, a plurality of small diameter tubes and a matric chamber and the substantially viscosity independent flow restrictor is an orifice.

4. The flow control system as recited in claim 1 wherein the valve element has at least one third position between the first and second positions wherein fluid flow through the main fluid pathway is choked responsive to the pressure difference.

5. The flow control system as recited in claim 1 wherein the fluid control module has an injection mode, wherein the pressure difference between the pressure signals from the midstream pressure sensing location and the combination of the upstream and downstream pressure sensing locations created by an outflow of injection fluid shifts the valve element to the first position, and a production mode, wherein the pressure difference between the pressure signals from the midstream pressure sensing location and the combination of the upstream and downstream pressure sensing locations created by an inflow of production fluid shifts the valve element to the second position.

6. The flow control system as recited in claim 1 wherein the fluid control module has a first production mode, wherein the pressure difference between the pressure signals from the midstream pressure sensing location and the combination of the upstream and downstream pressure sensing locations created by an inflow of a desired fluid shifts the valve element to the first position, and a second production mode, wherein the pressure difference between the pressure signals from the midstream pressure sensing location and the combination of the upstream and downstream pressure sensing locations created by an inflow of an undesired fluid shifts the valve element to the second position.

7. The flow control system as recited in claim 1 wherein a fluid flowrate ratio between the main fluid pathway and the secondary fluid pathway is between about 20 to 1 and about 100 to 1.

8. A flow control screen comprising:

a base pipe with an internal passageway;

a filter medium positioned around the base pipe;

a housing positioned around the base pipe defining a fluid flow path between the filter medium and the internal passageway; and at least one fluid control module having a main fluid pathway, a valve element disposed within the fluid control module, the valve element having a first position wherein fluid flow through the main fluid pathway is allowed and a second position wherein fluid flow through the main fluid pathway is prevented and a pressure sensing module including a secondary fluid pathway in parallel with the main fluid pathway, the pressure sensing module having an upstream pressure sensing location, a midstream pressure sensing location and a downstream pressure sensing location, a first flow restrictor having a first sensitivity to viscosity is positioned between the upstream and the midstream pressure sensing locations, a second flow restrictor having a second sensitivity to viscosity is positioned between the midstream and the downstream pressure sensing locations;

wherein the valve element is moved between the first and second positions responsive to a pressure difference between pressure signals from the midstream pressure sensing location and a combination of the upstream and downstream pressure sensing locations; and wherein the pressure difference is dependent upon the viscosity of a fluid flowing through the secondary fluid pathway such that the viscosity of the fluid is operable to control fluid flow through the main fluid pathway.

9. The flow control screen as recited in claim 8 wherein one of the first and second flow restrictors is a viscosity sensitive flow restrictor and the other of the first and second flow restrictors is a substantially viscosity independent flow restrictor.

10. The flow control screen as recited in claim 9 wherein the viscosity sensitive flow restrictor is selected from the group consisting of a torturous path element, a plurality of small diameter tubes and a matric chamber and the substantially viscosity independent flow restrictor is an orifice.

11. The flow control screen as recited in claim 8 wherein the valve element has at least one third position between the first and second positions wherein fluid flow through the main fluid pathway is choked responsive to the pressure difference.

12. The flow control screen as recited in claim 8 wherein the fluid control module has an injection mode, wherein the pressure difference between the pressure signals from the midstream pressure sensing location and the combination of the upstream and downstream pressure sensing locations created by an outflow of injection fluid shifts the valve element to the first position, and a production mode, wherein the pressure difference between the pressure signals from the midstream pressure sensing location and the combination of the upstream and downstream pressure sensing locations created by an inflow of production fluid shifts the valve element to the second position.

13. The flow control screen as recited in claim 8 wherein the fluid control module has a first production mode, wherein the pressure difference between the pressure signals from the midstream pressure sensing location and the combination of the upstream and downstream pressure sensing locations created by an inflow of a desired fluid shifts the valve element to the first position, and a second production mode, wherein the pressure difference between the pressure signals from the midstream pressure sensing location and the combination of the upstream and downstream pressure sensing locations created by an inflow of an undesired fluid shifts the valve element to the second position.

14. The flow control screen as recited in claim 8 wherein a fluid flowrate ratio between the main fluid pathway and the secondary fluid pathway is between about 20 to 1 and about 100 to 1.

15. The flow control screen as recited in claim 8 wherein the at least one fluid control module further comprises a plurality of fluid control modules.

16. A downhole fluid flow control method comprising:

positioning a fluid flow control system at a target location downhole, the fluid flow control system including at least one fluid control module having a main fluid pathway, a valve element disposed within the fluid control module, the valve element having a first position wherein fluid flow through the main fluid pathway is allowed and a second position wherein fluid flow through the main fluid pathway is prevented and a pressure sensing module including a secondary fluid pathway in parallel with the main fluid pathway, the pressure sensing module having an upstream pressure sensing location, a midstream pressure sensing location and a downstream pressure sensing location, a first flow restrictor having a first sensitivity to viscosity is positioned between the upstream and the midstream pressure sensing locations, a second flow restrictor having a second sensitivity to viscosity is positioned between the midstream and the downstream pressure sensing locations;

producing a desired fluid through the fluid control system;

generating a first pressure difference between pressure signals from the midstream pressure sensing location and a combination of the upstream and downstream pressure sensing locations that biases the valve element toward the first position, the first pressure difference being dependent upon the viscosity of the desired fluid flowing through the secondary fluid pathway;

producing an undesired fluid through the fluid control system; and generating a second pressure difference between the pressure signals from the midstream pressure sensing location and the combination of the upstream and downstream pressure sensing locations that biases the valve element toward the second position, the second pressure difference being dependent upon the viscosity of the undesired fluid flowing through the secondary fluid pathway, thereby controlling fluid flow through the main fluid pathway responsive to the viscosity of the fluid flowing through the secondary fluid pathway.

17. The method as recited in claim 16 wherein producing the desired fluid through the fluid control system further comprises producing a formation fluid containing at least a predetermined amount of oil.

18. The method as recited in claim 16 wherein producing the undesired fluid through the fluid control system further comprises producing a formation fluid containing at least a predetermined amount of gas.

19. The method as recited in claim 16 wherein producing the undesired fluid through the fluid control system further comprises producing a formation fluid containing at least a predetermined amount of water.

20. The method as recited in claim 16 further comprising generating a third pressure difference between the pressure signals from the midstream pressure sensing location and the combination of the upstream and downstream pressure sensing locations that shifts the valve element between the first position and the second position wherein fluid flow through the main fluid pathway is choked.

* * * * *